US007054451B2

(12) United States Patent
Janse et al.

(10) Patent No.: US 7,054,451 B2
(45) Date of Patent: May 30, 2006

(54) SOUND REINFORCEMENT SYSTEM HAVING AN ECHO SUPPRESSOR AND LOUDSPEAKER BEAMFORMER

(75) Inventors: Cornelis Pieter Janse, Eindhoven (NL); Harm Jan Willem Belt, Leuven (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 196 days.

(21) Appl. No.: 10/483,854

(22) PCT Filed: Jun. 24, 2002

(86) PCT No.: PCT/IB02/02576

§ 371 (c)(1),
(2), (4) Date: Jan. 14, 2004

(87) PCT Pub. No.: WO03/010996

PCT Pub. Date: Feb. 6, 2003

(65) Prior Publication Data

US 2004/0170284 A1 Sep. 2, 2004

(30) Foreign Application Priority Data

Jul. 20, 2001 (EP) ..... 01202791

(51) Int. Cl.
*H04R 27/00* (2006.01)

(52) U.S. Cl. ..... 381/83; 381/66; 381/93

(58) Field of Classification Search ..... 379/406.01–406.16; 381/82–83, 92–93, 307, 381/386, 387, 66, 86
See application file for complete search history.

(56) References Cited

U.S. PATENT DOCUMENTS 5,677,987 A * 10/1997 Seki et al. ..... 381/93
5,768,398 A * 6/1998 Janse et al. ..... 381/93
5,771,440 A * 6/1998 Sukhu et al. ..... 381/93
6,535,609 B1 * 3/2003 Finn et al. ..... 381/93

FOREIGN PATENT DOCUMENTS

JP 11055784 A * 2/1999

OTHER PUBLICATIONS

JPO Machine Translation of JP 11 055784 A.*

* cited by examiner

*Primary Examiner*—Daniel Swerdlow

(57) ABSTRACT

A sound reinforcement system includes several microphones, a microphone beamformer coupled to the microphones, adaptive echo compensator (EC) coupled to the microphone beamformer for generating an echo compensated microphone signal, and several loudspeakers coupled to the adaptive EC. An adaptive loudspeaker beamformer is coupled between the adaptive EC and the loudspeakers for shaping the directional pattern of the loudspeakers. The adaptive loudspeaker beamformer creates a beam pattern which is capable of creating a "null" in the direction of speaker(s) such that howling is effectively prevented.

20 Claims, 1 Drawing Sheet

SOUND REINFORCEMENT SYSTEM HAVING AN ECHO SUPPRESSOR AND LOUDSPEAKER BEAMFORMER

The present invention relates to a sound reinforcement system comprising at least one microphone, adaptive echo compensation (EC) means coupled to the at least one microphone for generating an echo compensated microphone signal, and at least one loudspeaker coupled to the adaptive EC means.

Such a sound reinforcement system is known from applicants U.S. Pat. No. 5,748,751. The known sound reinforcement system is provided with a microphone, adaptive echo compensation (hereafter indicated EC) means in the form of an adaptive echo canceller filter coupled to the microphone for generating an echo compensated microphone signal. The system further has a loudspeaker and an amplifier coupled to the adaptive EC means.

It is a disadvantage of the known sound reinforcement system that if two or more loudspeakers are connected to the sound reinforcement system the output sound quality leaves much to be desired, in particular in terms of sound direction, echo and/or reverberation.

Therefore it is an object of the present invention to provide an improved sound reinforcement system capable of effectively tailoring sound direction, echo and reverberation properties, while still canceling various types of echoes, in particular in cases wherein a plurality of loudspeakers is used.

Thereto the sound reinforcement system according to the invention is characterized in that the sound reinforcement system further comprises a microphone beamformer coupled to the adaptive EC means; and an adaptive loudspeaker beamformer coupled between the adaptive EC means and several of the loudspeakers for shaping the directional pattern of the loudspeakers.

It is an advantage of the sound reinforcement system according to the present invention that by shaping the directional pattern of the loudspeakers, possibly also for example in dependence on the echo and/or reverberation properties of a room or hall, the audibility of the system can be improved. Also the direction of the sound produced by the loudspeakers can be made dependent on the position or an area of expected movements of the speaker or speakers carrying the microphone or microphones respectively. Specifically the sound output can be made minimal at a respective speaker position. Advantageously the loudspeaker beamformer may create a beam pattern which is capable of creating a "null" in the direction of the speaker(s) such that howling is effectively prevented.

Several possible embodiments of the sound reinforcement system according to the invention are characterized in that the adaptive loudspeaker beamformer (11) is a Weighted Sum Beamformer, a Delay and Sum Beamformer or a Filtered Sum Beamformer.

Advantageously these embodiments link up closely with beamformer techniques already known per se.

A further embodiment of the sound reinforcement system according to the invention is characterized in that the adaptive loudspeaker beamformer is coupled to the microphone beamformer, while both beamformers have beamformer coefficients, such that the combined loudspeaker beam pattern and the combined microphone beam pattern are complementary.

It is advantage of the sound reinforcement system according to the invention that such an embodiment reduces the unwanted coupling between the loudspeaker beam which is directed to the speaker and the microphone beam in the vicinity of the speaker or speakers. This results in a reduced disturbing sound level, such that only a minimum amount of sound is directed to the active speaker.

A still further embodiment of the sound reinforcement system according to the invention is characterized in that the sound reinforcement system comprises a dynamic echo suppressor (DES) coupled between the microphone beamformer and the adaptive loudspeaker beamformer for suppressing remaining echoes by using a time delay between the amplitudes of a microphone signal frequency component and the same remaining echo frequency component.

It is an advantage of this sound reinforcement system according to the present invention that the application of the Dynamic Echo Suppressor or DES opens possibilities for tailoring the echo cancellation such that speaker room impulse responses, as well as variations therein due to people moving in the room are now included in the echo canceling process. This is mainly due to the fact that the DES essentially operates in the time domain for identifying a time delay between amplitudes of a multi microphones signal frequency component and its associated remaining echo frequency component. The remaining echo can therefore be filtered out more effectively which results in an enhanced speech intelligibility for sound reinforcement systems. This is particularly important for hands-free sound reinforcement systems, where people tend to wonder around in the room, and consequently echo and reverberation properties of the room may vary considerably. These varying properties are now included in the improved echo cancellation and in addition reduces the chances that howling due to feedback from loudspeaker(s) to microphone(s) may occur.

An embodiment of the sound reinforcement system according to the invention is characterized in that the DES is a dynamic echo noise suppressor (DENS).

Such a DENS advantageously makes use of spectral subtraction for suppressing stationary noise, while use is being made of the short time power of magnitude spectra of its input signals.

Another further embodiment of the sound reinforcement system according to the invention is characterized in that the sound reinforcement system comprises a decorrelator coupled between the adaptive EC means and the adaptive loudspeaker beamformer for decorrelation of the microphone signal.

Because the adaptive EC means will try to remove any auto-correlation in the speaker signal, a decorrelator is included in the sound reinforcement system according to the invention, in order to prevent a "whitening" of the wanted speaker signal.

A still further embodiment of the sound reinforcement system according to the invention is characterized in that the sound reinforcement system comprises a limiter coupled between the adaptive EC means and the adaptive loudspeaker beamformer for limiting gain in the sound reinforcement system.

It is an advantage of the sound reinforcement system according to the invention that the system remains stable even if amplifier gains are suddenly enlarged and microphones and/or loudspeakers are moved around in a room. Furthermore it additionally prevents howling in abnormal situations, by decreasing the roundtrip gain.

Still another embodiment of the sound reinforcement system according to the invention is characterized in that the sound reinforcement system comprises an equalizer coupled between the decorrelator and the adaptive loudspeaker beamformer.

Advantageously the equalizer flattens a possibly coarse frequency characteristic of the path between the loudspeakers and the listener(s).

The sound reinforcement system according to the invention, which may be a hands-free system may advantageously be embodied as a public address system, a congress system, a conferencing system, or a communication system such as a passenger communication system for a vehicle such as a car, aeroplane or the like.

At present the sound reinforcement system according to the invention will be elucidated further together with its additional advantages, while reference is being made to the appended drawing, wherein similar components are being referred to by means of the same reference numerals. In the drawing.

Figure 1:
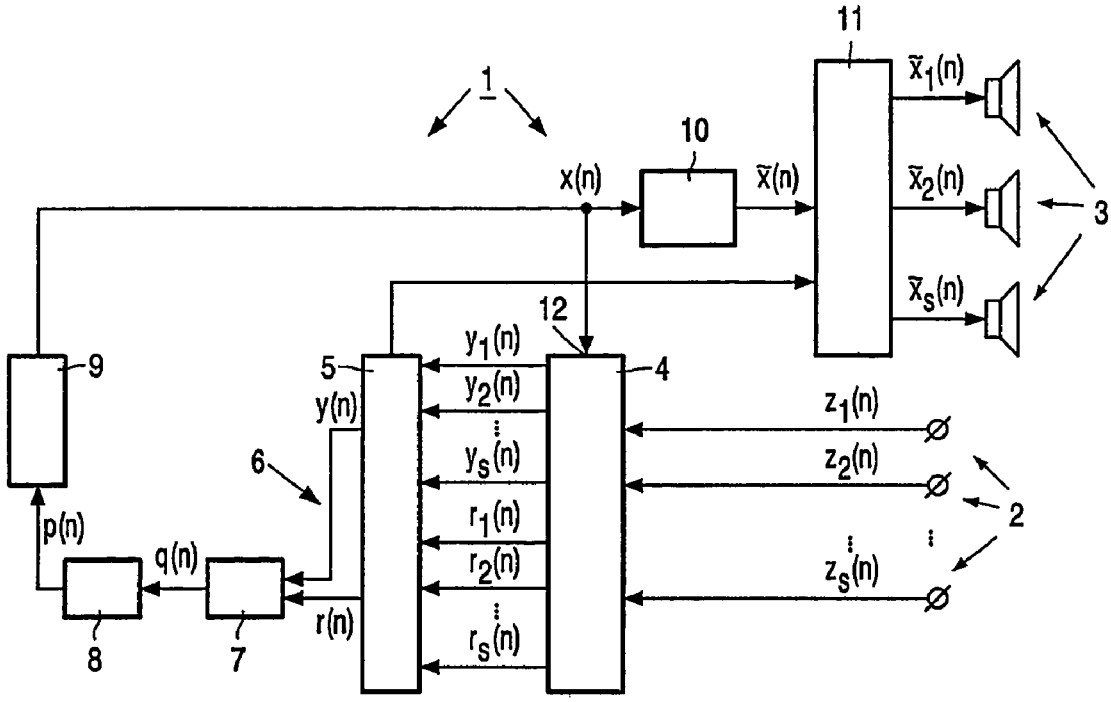
FIG. 1 shows a schematic diagram of a fully equipped sound reinforcement system with the help whereof several possible sub embodiments of the system will be elucidated.

FIG. 1 shows a block diagram of a total sound reinforcement system 1. The system 1 may range from a public address system where only one speaker addresses a large audience to a congress system where the role of listener and speaker changes continuously among participants. The system 1 comprises one or more microphones 2 and one or more loudspeakers 3. Together with appropriate signal processing it is possible to create radiation patterns for both a loudspeaker array 3 and a microphone array 3.

In all applications of such a system 1 the aim is to enhance the speech intelligibility. Without such a system the speech intelligibility is often too low because of a low Signal-to-Noise Ratio (SNR) or because the reverberation is too high. Without extra measures the microphone(s) 2 that are used have to be close to the mouth of the participants and only one speaker can be active at a certain time. Only then it can be guaranteed that the acoustic feedback between the loudspeaker(s) 3 and the microphone(s) is low and that no howling occurs at sufficiently high sound output powers. It also guarantees that the microphone signal has a good SNR and that direct sound field component dominates the diffuse sound field component, i.e. the microphone signal does not sound reverberated.

In a number of applications the participants do not want to have the microphones 2 close to their mouth and do not want to push a button once they want to speak. An example is a boardroom conference, where people are sitting around a large table and want to work and communicate without being hindered by communication equipment. This is possible by placing the microphones 2 and loudspeakers 3 further away and allow simultaneous talking. Another application is conferencing within a car. Due to the large background noise and the position of the driver and the passengers the speech intelligibility is usually low. An attractive solution here is to locate microphones 2 in the neighborhood of the participants (in the ceiling for example) and use the distributed loudspeakers 3 of the audio system within the car.

In the above-mentioned situations additional signal processing has to be applied to guarantee that at the required sound pressure levels no howling occurs and that the speech that is picked up by the microphones 2 is enhanced, i.e. the background noise is removed and reverberation of the desired speech signal is suppressed.

A similar problem is encountered with systems 1 like loudspeaking (or hands-free) telephony and video conferencing systems. Also then the user wants to move around freely and does not want to be bothered by the communication equipment. The latter includes that the connection is full-duplex. Signal processing is needed then to remove the acoustic echoes and reverberation of the desired speech, and additional processing may be needed to remove the background noise.

The system 1 further comprises adaptive echo canceling (EC) filter means 4. Within this filter means 4 the transfer function of each loudspeaker-microphone pair is estimated and with this transfer function the echo $y_s(n)$ (with s the channel index) in each microphone signal $z_s(n)$ can be estimated and subsequently be subtracted from each microphone signal. The relating signal is called the residual signal $r_s(n)$. The outputs of the adaptive filter means 4 contain for each channel s both the estimated echo $y_s(n)$ and the residual signal $r_s(n)$.

The system 1 also comprises a microphone beamformer 5 coupled to the filter means 4. The task of this beamformer 5 is to focus the beam on the active speaker, that is the input signals $r_s(n)$ are filtered (or weighted) and summed together in such a way, that the active speaker signal is emphasized, and reverberation and possibly background noise are suppressed. The filter coefficients (or weights) are determined adaptively, but it requires that during adaptation there is no (strong) echo. Contrary to the conferencing applications, where we can adapt the microphone beamformer 5 when only the near-end speaker is active, we now always have double talk and have to remove the echoes first. The microphone beamformer 5 has as inputs the residual signals $r_s(n)$ and delivers an enhanced signal r(n) at its output 6. In addition the estimated echoes $y_s(n)$ are treated in exactly the same way as the residual signals $r_s(n)$, giving the output signal y(n). The signal y(n) is needed by a Dynamic Echo Suppressor (DES) 7, which may be a Dynamic Echo Noise Suppressor (DENS), as will be explained hereafter.

The DES 7 suppresses the remaining echoes and embodied as DENS 7 also suppresses (stationary) noise components, without distorting the near-end signal (if possible). Within the residual signals there will always be some remaining echoes for the following reasons. First, the number of coefficients of the adaptive filters 4 are too small to model the room impulse responses completely, and secondly the adaptive filter 4 is not able to track the variations in the impulse response when people are moving. The DENS 7 has strong similarities with spectral subtraction for stationary noise suppression and uses the short-time power or magnitude spectra of y(n), r(n) and z(n) respectively, where z(n) is calculated within the DENS as $z(n)=y(n)+r(n)$ and can be seen as the output 6 of microphone beamformer 5 with the signal 4(n) as inputs of the filters 4. The requirements for the DENS 7 are much stronger when compared with teleconferencing. With teleconferencing possible distortions of the far-end speaker due to the DENS at the far-end side are masked by the near-end speaker itself. Moreover, double talk does not occur often in teleconferencing applications. With sound reinforcement systems 1, there is always double talk and the loudspeaker output perceived by the listeners is generally much stronger than the near-end speaker and as a result, possible artifacts are not masked by the near-end speaker.

The system 1 may also comprise a limiter 8. To guarantee that the system 1 remains stable even if amplifier gains are suddenly enlarged and microphones 2 and/or loudspeakers 3 are moved, a limiter 8 is added to the system 1. Its task is to prevent howling in abnormal situations, by decreasing the gain.

A decorrelator 9 will also be included in the sound reinforcement system 1. A decorrelator will generally be necessary for proper operation of the adaptive filter 4. The adaptive filter 4 tries to decorrelate its residual signal r, with its input signal x. Without a decorrelator 9 x is just a scaled version of r and, as a result, the adaptive filter 4, tries to remove the autocorrelation of the desired speaker, i.e. tries to "whiten" the desired speaker. By applying a decorrelator we can solve this problem. It is essential of course, that the decorrelation does not change the perceptual quality of the desired signal. For speech signals a decorrelator 9 embodied as a frequency shifter is a very good candidate. With a shift of about 5 Hz, the decorrelation properties are good, perceptual quality remains good and it even helps to keep the total system 1 stable in situations where the acoustic path is suddenly changed.

An equalizer 10 may also be included in the system 1. Details of such an equalizer are set out in applicants published International patent application WO 96/32776, the content whereof is included here by reference thereto. With the equalizer 10 the coarse frequency characteristic of the loudspeaker-listener path(s) is (are) flattened. When the loudspeaker(s)-microphone(s) paths are a good estimate for this (usually the case when the loudspeaker(s) 3 and microphone(s) 2 are not close together), then also information from the transfer functions from the adaptive filter 4 can be used to automatically adapt filters present in the equalizer.

In another possible embodiment the system 1 comprises a loudspeaker beamformer 11 in case there are two or more loudspeakers 3. The loudspeaker beamformer 11 can be used to create a beam pattern that focuses on the listeners. It may then take information from the microphone beamformer 5 and is then able to achieve a null in the direction of the speaker.

Although problems between sound reinforcement systems 1 applied as handsfree teleconferencing systems and "hands-free" sound reinforcement systems are similar there are three aspects which will be mentioned here that make the sound reinforcement case technically more difficult:

1) The adaptive filter 4 that is used to remove the estimated echo is never able to learn in a situation where the echo is not disturbed by a near-end speaker. This is because the near-end speaker acts as the driving force for the loudspeaker signal, whereas in a teleconferencing case the far-end speaker acts as the driving force.
2) There is continuously a situation of double talk, being the most difficult situation. In a teleconferencing application most of the time either the far-end talker or the near-end talker is active. If during double talk, the far-end talk is a little distorted, because of inappropriate echo cancellation at the far-end side, this is easily masked by the near-end speaker. This holds for the near-end speaker himself, but also for listeners in the near-end room. With sound reinforcement systems the perceived loudspeaker signal is much stronger and much less use can be made of the masking effect
3) Algorithmic delay should be minimized. The total delay between the microphone signal and the loudspeaker signal should be less than ten msec.

A general architecture for a "hands-free" sound reinforcement system 1 is proposed that copes with the difficulties just mentioned. However the architecture disclosed allows various modifications, also the ones already mentioned above.

The adaptive filter section 4 will be embodied in dependence on the specific arrangement as to the number of microphones 2 and loudspeakers 3 which are included in the sound reinforcement system 1. Such specific arrangements having one microphone and one loudspeaker, one microphone and several loudspeakers, several microphones and one loudspeaker, or several microphones and several loudspeakers are known per se in the prior art.

The microphone beamformer 5 has the task to focus the beam on the active speaker by filtering or weighting the different inputs and summing them together in such a way that the active speaker signal is emphasized and that the background noise and reverberation is suppressed. In some applications it is important that an adaptive beamformer is available that can track a moving speaker. The most well-known adaptive beamformer is a Delay-and-Sum beamformer, where it is assumed that the desired speech signals in the microphone signals are delayed versions of each other, depending on the direction of arrival. By correlating the microphone signals the delays can be determined and, for spatially white noise, a logarithmic attenuation can be obtained. The free field assumption on which the Delay-and-Sum beamformer is based, is often not valid in practice. Especially if the microphone array 2 is placed close to other objects, like a table or a wall or is placed on top of a monitor, the speech signals are not just delayed versions of each other but also contain severe reflections and reverberation. Determination of the delays is not obvious then and the overall performance is not optimal. Alternative adaptive beamformers are a Weighted Sum Beamformer (WSB) and a Filtered Sum Beamformer (FSB). Details of such adaptive beamformers are set out in applicants published International patent application WO 99/27522, the content whereof is included here by reference thereto. Within the WSB each microphone signal is weighted and summed. The weights are (adaptively) determined such that the output power is maximized under certain constraints. Such a WSB is particularly suited for applications where the microphones 2 point away from each other, or in applications where the microphones 2 are far away from each other. With the FSB each microphone signal is filtered with an FIR filter and summed. Also here the weights are adaptively determined in such a way that the output power is maximized under a certain constraint. The Filtered Sum Beamformer is especially suited for cases where the microphones all pick up a significant portion of the sound together with first reflections. The FSB filters automatically compensate for the delays and first reflections. The WSB and FSB filters 5 can be extended to so-called Generalized Sidelobe Cancellers. Apart from the enhanced speech signal the WSB and FSB can be extended with additional outputs that contain mainly noise. The outputs can serve as reference inputs for a subsequent multichannel adaptive noise canceller, where the enhanced speech output of the beamformer serves as primary input. In this way the noise can be further reduced.

Figure 2:
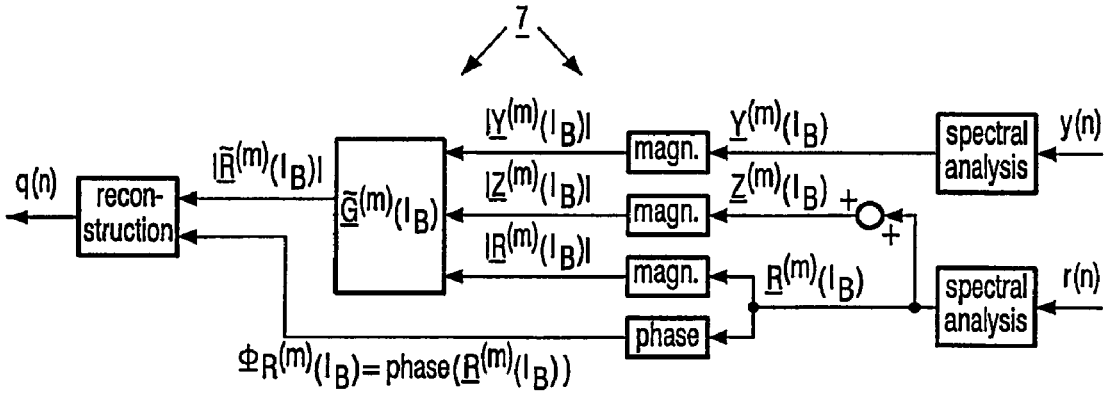
FIG. 2 shows possible embodiment of a Dynamic Echo Suppressor (DES) for application in the sound reinforcement system of FIG. 1.

The Dynamic Echo Suppressor (DES) 7 which may possibly be extended to a Dynamic Echo Noise Suppressor (DENS) 7 can successfully be used for acoustic echo canceling. With reference to FIG. 2 a brief description of its operation follows, but first some notational conventions used hereafter will be given.

The sampling index is denoted by n (n=. . . , 1, 0, 1, . . . ). We use block processing where a real-valued discrete time signal x(n) is segmented according to $x(Bl_B-$ 1), with B the data block size, $l_B$ the block index according to $l_B=\lfloor n/B \rfloor$ (here $\lfloor . \rfloor$ denotes integer truncation), and 1=0, 1, . . . , B−1. Thus the newest available data sample of x(n) is $x(Bl_B)$. The M-points DFT result of x is denoted by $X(k;l_B)$ with k the frequency index (k=0, 1, . . . , M−1). Note that with real-valued time-domain data we do not need to consider negative frequencies in a practical implementation, but for notational convenience we will here continue to do so. $F_{samp}$ is the sampling rate in Hertz, FIR stands for Finite Impulse Response and IIR for Infinite Impulse Response, N denotes the number of the FIR filter coefficients.

The DES 7 (we leave out the noise component for a moment) takes as its input segmented time frames and transforms these frames into magnitude spectra, denoted by $|Y(k;l_B|$, $|Z(k;l_B|$, and $|R(k;l_B|$. It next applies a frequency-dependent (non-negative) attenuation $G(k;l_B)$ to $|R(k;l_B)|$ yielding $|\check{R}(k;l_B)|$. The time-domain signal q(n) is reconstructed by an inverse spectral transformation on $|\check{R}(k;l_B)|\exp\{-j\phi_R(k;l_B)\}$, with $j\phi_R(k;l_B)$ the phase of the residual spectrum $|R(k;l_B)|$. The attenuation function $\check{G}(k;l_B)$ is calculated as follows. First per frame an attenuation function $G(k;l_B)$ is calculated according to:

$$G(k;l_B)=\max[(|Z(k;l_B)|-\gamma_e\{|Y(k;l_B)|+|Y_r(k;l_B)|\})\backslash|R(k;l_B)|, 0]$$

with $l_B$ the frame number, $\gamma_e$ the subtraction factor for the echo term, and $|Y_r(k;l_B)|$ an estimate of the residual echo magnitude to compensate for the fact that the adaptive filter has too few coefficients to model the complete (infinite length) room impulse response. To prevent $G(k;l_B)$ to change to rapidly between iterations we apply a low-pass recursion according to:

$$\check{G}(k;l_B)=\alpha\check{G}(k;l_B-1)+(1-\alpha)\ G(k;l_B),\ \forall k.$$

Thus, in frequency bands with a strong far-end echo (Y is an estimate of the echo) when compared with the near-end signal the residual R is attenuated, and in bands where the near-end signal is much stronger than the far-end echo the residual remains approximately the same. With teleconferencing applications use is made of the assumption that the short-time spectrum of the far-end signal differs from the short-time spectrum of the near-end signal and we can suppress the echo components without suppressing the near-end signal. With sound reinforcement systems the situation is different. The spectrum of the near-end speech does not differ significantly from the spectrum of the echo, since the near-end speaker is the driving force. The difference in time-scale between the near-end speech and the echoes can however be used.

Figure 3:
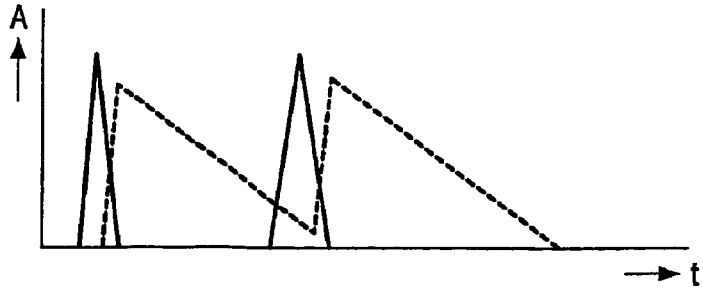
FIG. 3 shows amplitude versus time graphs of a near end signal (solid line) and an echo signal (dotted line) respectively for explaining the operation of the DES of FIG. 2.

In FIG. 3 the magnitude for a certain frequency component of the microphone signal is given as a function of time. The solid line depicts the near-end signal whereas the dotted line gives the echoes. The echoes start after the near-end signal due to the processing delay, and the acoustic propagation delay between the loudspeaker and the microphone. The decay is determined both by the reverberation time of the room and the open loop gain of the system. Let us now check how the DES reacts in this case: $|Y(k;l_B)|+|Y_r(k;l_B)|$ is an estimate of the echo (the dotted line in FIG. 3). When the estimate is accurate and the echoes are uncorrelated with the near-end signal and we would have subtracted the squared estimate from the squared z-signal then the result would be equal to the squared near-end speech signal. The estimate is not so accurate however and experiments have shown that we can take as well the amplitudes together with oversubtraction ($\gamma_e$>1). If we oversubtract the echo then it follows from FIG. 3 that only the decay of the near-end speech is distorted. During the attack and after the decay there will be no distortion. During the decay the distortion is not so important. Because of the reverberation in the room we can even say that the decay of the speech is already distorted by this reverberation. Experiments have shown that there is indeed some dereverberation effect when we apply some oversubtraction. The larger the loop gain is the more important it is that the combination of adaptive filter and DES subtracts or suppresses the echoes. At very large gains (up to 20 dB!) stability is more an issue than some distortion during the decay of the near-end speech, as opposed to the situation where the loop gain is less than one. For this reason $\gamma_e$ depends on the loop gain. The loop gain can directly be obtained from the weights of the adaptive filter means 4, since they represent the frequency characteristic between the microphone 2 and loudspeaker 3 and determine the open loop gain if the rest of the system has a gain of unity. $\gamma_e$ is chosen smaller than one if the maximum loop gain is smaller than one and larger than one if the maximum loop gain is larger than one.

Another problem to be addressed is the algorithmic delay of the DENS. Normally, the DENS is a linear phase filter and gives an extra delay that equals the data block length B of the DES. If a DENS is implemented as a minimum-phase filter then no extra delay is added.

The task of the limiter 8 is to reduce the gain of the system in case the system 1 becomes unstable, due for example to the movement of a microphone or loudspeaker, or to the sudden increase of the loudspeaker volume. It is especially important if the system is designed for operation far above howling. In such a situation the echoes are much stronger than the signal of the near-end speaker and the gain of the microphone preamplifier is determined by the echo. As a result after compensating the echoes with the adaptive filter 4 and the DES or DENS7 there will be a huge head-room for the near-end speech. A limiter may then be necessary to reduce the gain, if the echoes are not compensated well, during drastic changes in the loudspeaker-microphone path(s). The limiter function itself is a standard one. The limiter gain may be the product of two gains: an attack gain and a decay gain.

$$G_l=G_aG_d$$

Normally $G_l$ equals one. Once the smoothed power $P_s$ of the output signal q(n) exceeds a threshold $P_{limit}$, a gain ratio $G_r$ is determined as:

$$G_r=\sqrt{(P_s/P_{limit})}$$

and $G_g$ is put equal to $G_l$.

$G_a$ and $G_d$ are then given by:

$$G_a=(G_g/G_r)+(G_g-(G_g/G_r))\exp(-t/T_a)$$

and $$G_d=(G_r/G_g)+(1-(G_r/G_g))\exp(-t/T_b)$$

Typical values for $T_a$ and $T_b$ are 0.01 and 5.0 seconds respectively. As a result $G_l$ decreases rapidly toward $G_g/G_r$ and subsequently grows slowly to 1 again.

As explained above a decorrelator is necessary to prevent that the adaptive filter 4 tries to "whiten" the desired signal. Details of such a decorrelator are set out in applicants U.S. Pat. No. 5,748,751, the content whereof is included here by reference thereto. For speech applications a frequency shifter performs very well. When a frequency shift of approximately 5 Hz is applied, it both decorrelates the signal and helps to keep the system 1 stable as well. The frequency characteristic between a loudspeaker 3 and a microphone 2 in a room shows many peaks and dips. The average frequency spacing between adjacent minima and maxima is only a few Hz. When a frequency shifter is applied the average loop gain becomes important instead of the maximum loop gain.

For gains with a maximum loop gain above 0 dB and an average loop gain below 0 dB a system with a frequency shifter, but without an adaptive filter, remains stable. The artefacts however, are disturbing because of the roundtrips of the sound (each time with a shift of 5 Hz) through the loop. With an adaptive filter 4 (and a DE(N)S) the attenuation provided by the adaptive filter is sufficient to suppress these artefacts.

In possible embodiments of the sound reinforcement system 1 a parametric equalizer 10 is used to adjust the frequency response. Often an octave or ⅓-octave band equalizer is used, i.e. the bandwidth increases with increasing frequency. The adjustment of the equalizer 10 is mostly done off-line. A white or pink noise source is used as excitation source and a microphone is placed at the position of the listener. The response is measured in octaves or ⅓-octaves and the equalizer 10 is adjusted until a flat (or otherwise desired) response is obtained. If more listeners are available (often the case) the procedure is repeated and an average curve is obtained. A drawback of this method is that the adjustment is fixed. If the conditions change, (full or empty room for example), no adjustments can be made anymore. From experiments we have found that the frequency characteristic between the loudspeaker 3 and microphone 2 (especially if the loudspeaker is not too close to the microphone), when measured in octaves or ⅓-octaves, is representative for the transfer function between the loudspeaker and the participant(s). In such a situation we can use the estimate of the adaptive filter 4 for adjusting the equalizer 10. The adjustment may be done automatically and iteratively if the equalizer 10 is placed after the input 12 of the adaptive filter means 4 as is shown in FIG. 1. That is, the adaptive filter 4 tries to estimate the transfer function of the combination of the equalizer 10 and the acoustic path. For a single loudspeaker—multiple microphone case the same can be done. In that case one has to calculate an average transfer function from the available transfer functions in the adaptive filter 4. In case of a multiple loudspeaker—single microphone case there are two possibilities: An equalizer 10 can be placed in each loudspeaker path and the same procedure can be used as for the single loudspeaker—single microphone case, or an equalizer can be placed before the loudspeaker beamformer 11. When using the background model concept of the adaptive filter 4 the transfer function to be used for estimating the equalizer coefficients is given by the sum of the individual transfer functions weighted or convoluted by the coefficients or FIR-filters of the loudspeaker beamformer 11.

With the loudspeaker beamformer 11 we are able to shape the directional pattern of the loudspeaker array 3. As was the case with the microphone beamformer 5 also the loudspeaker beamformer is adaptive. Contrary to the microphone beamformer 5, it is not obvious how to adapt the loudspeaker beamformer, i.e. where the loudspeaker beamformer has to point to. Extra measures are necessary to let the system 1 know where the listeners are located. Possibilities are an attention button at the beginning of a meeting (conference application), video tracking using a camera to extract the positions of listeners and the like. Depending on the loudspeaker configuration a Weighted Sum Beamformer, a Delay and Sum Beamformer or even a Filtered Sum Beamformer can be used. It is important that all individual amplifiers have the same gain and that there is one overall gain adjustment. Otherwise the radiation pattern depends on the differences in amplification values of the individual amplifiers. If the information with respect to the listeners is not available, then the beamformer still can be useful by not pointing to the active speaker. For the speaker the sound that is directed to him is not of any use, it is even disturbing. Also, the acoustic coupling between the loudspeaker beam that is directed to the speaker and the microphone beam (also directed to the speaker) will be large in general. Reducing this coupling will improve overall system behavior. Note that in this case the loudspeaker beamformer 11 is determined by the settings of the microphone beamformer 5. If for example both the microphone and loudspeaker beamformer are Weighted Sum Beamformers and the coefficients ($w_1$, $w_2$, . . . $w_s$) of the microphone beamformer 5 are (1, 0, . . . . 0), then the coefficients ($w_{11}$, $W_{12}$, . . . $w_{ls}$) of the loudspeaker beamformer 11 will be equal to (0, 1, . . . 1). In addition it is to be noted that in this case equally indexed loudspeakers and microphones cover the same acoustic area in the room concerned.

In this section three applications are described. The first one has to do with a high-end speakerphone unit with multiple microphones and a single loudspeaker. The second one has to do with multiple units and the third one has to do with a sound reinforcement system within a car.

The speakerphone unit can be used for audio conferencing applications. It is also possible however to use it for sound reinforcement in boardrooms. The block diagram of the processing is shown in FIG. 1. The Microphone beamformer 5 in this case consists of a Weighted Sum Beamformer that picks up the speech signal as is the case with audio conferencing. Also in this case external microphones 2 can be used if the participants are far away from the unit. The output of the beamformer 5 is fed through the DES/DENS 7, the limiter 8, frequency shifter decorrelator 9 to the input 12 of the adaptive filter means 4, and after passing the equalizer 10 to the loudspeaker 3. If there is only one loudspeaker 3, there is no need for a loudspeaker beamformer 11. One might think of a speakerphone unit with three loudspeakers, each pointing in the direction of a corresponding microphone. A loudspeaker beamformer 11 coupled to the microphone beamformer 5 can be used then, as explained above. The loudspeaker 3 emits the sound and the adaptive filters 4 compensate for the echoes. In larger meeting rooms one sound unit is not enough. The extension microphones should then be replaced by other sound units. In such an application we have a master sound unit and one or more slave sound units. In addition to the echo corrected microphone signals from the slaves to the master, now also the loudspeaker signal from the master has to be transported to the slaves. An extra Weighted Sum Beamformer (WSB) may then be added between the limiter 8 and the decorrelator 9 which WSB sums (after weighting) the cleaned echo signal of the sound unit itself and the signals coming from the slave sound units. The output signal that is send to the slave sound units is obtained after the frequency shifter decorrelator 9.

An interesting application is found in a car environment. The passengers at the back of the car often do not understand the driver and the passengers in front of the car, due to the orientation of the speakers and the background noise. By placing a microphone 2 close to all participants (e.g. in the roof of the car) and using the already existing loudspeakers 3 in the car, a sound reinforcement system 1 can be setup as is depicted in FIG. 1. The adaptive beamformer 5 is again a WSB that acts as a fast microphone selector, the DENS does not only suppress the residual echoes but also the stationary noise. We can work with a single loudspeaker—multiple microphone configuration, but we can also introduce a loudspeaker beamformer 11 and suppress the loudspeaker that is used for the person that speaks. In that case we need the adaptive background model concept as was explained in the above.

In this section some implementation details are given for a sound system 1 with only one loudspeaker 3 and without an equalizer 10. A system has been developed with a sample frequency of 16 kHz. To reduce the algorithmic delay block processing with a block size B of only 64 samples is used (when compared with 256 samples in the audio conferencing application). As is depicted in FIG. the programmable filter part of the adaptive filter 4, the beamformer 5, the filter part of the DES/DENS 7, the limiter 8 and the decorrelator 9 all operate on blocks of B samples. Working with blocks in a closed loop system gives some problems, unless there is somewhere a delay of at least B samples. Due to a serial to parallel conversion in the microphone path and the parallel to serial conversion in the loudspeaker path the impulse response will always contain at least 2B samples. It is advantageous then to put a delay of at least 2B samples in front of both the adaptive filter means 4, since this delay models the at least first 2B samples of the impulse response. For the filter length of the adaptive filter N=2048 is chosen. For the adaptive filter means 4 itself both an unconstrained Block Frequency Domain Adaptive Filter (BFDAF) has been used as well as a (constrained) Partitioned Block Frequency Domain Adaptive Filter (PBFDAF) has been used. Thereto reference is again made to U.S. Pat. No. 5,748,751. For the PFDAF a partition length of 512 coefficients has been used. For the analysis part of the DENS a data block size of 512 points is taken.

It is thus presented a "hands-free" sound reinforcement system that comprises an adaptive filter section 4, a microphone beamformer 5, a dynamic echo suppressor DES 7 and possible noise suppressor DENS 7 and a decorrelator 9. Optionally a limiter 8, an equalizer 10 and a loudspeaker beamformer 11 can be added. We presented two major applications. The first one deals with boardroom applications, where a board of directors needs a real handsfree sound reinforcement system 1, whereas the second one deals with a hands-free sound reinforcement system 1 in a car environment.

Whilst the above has been described with reference to essentially preferred embodiments and best possible modes it will be understood that these embodiments are by no means to be construed as limiting examples of the devices concerned, because various modifications, features and combination of features falling within the scope of the appended claims are now within reach of the skilled person.

The invention claimed is:

1. A sound reinforcement system comprising at least one microphone, adaptive echo compensation (EC) means coupled to the at least one microphone for generating an echo compensated microphone signal, and at least one loudspeaker coupled to the adaptive EC means, a microphone beamformer coupled to the adaptive EC means; and an adaptive loudspeaker beamformer coupled between the adaptive EC means (4) and several of the loudspeakers for shaping the directional pattern of the loudspeakers, said directional pattern including a null in a direction of a speaker.

2. The sound reinforcement system of claim 1, wherein the adaptive loudspeaker beamformer is a Weighted Sum Beamformer, a Delay and Sum Beamformer or a Filtered Sum Beamformer.

3. The sound reinforcement system of claim 1, wherein the adaptive loudspeaker beamformer is coupled to the microphone beamformer, while both beamformers have beamformer coefficients, such that the combined loudspeaker beam pattern and the combined microphone beam pattern are complementary.

4. The sound reinforcement system of claim 1, further comprising a Dynamic Echo Suppressor coupled between the microphone beamformer and the adaptive loudspeaker beamformer for suppressing remaining echoes by using a time delay between the amplitudes of a microphone signal frequency component and the same remaining echo frequency component.

5. The sound reinforcement system of claim 4, wherein the Dynamic Echo Suppressor (7) is a dynamic echo noise suppressor.

6. The sound reinforcement system according to claim 1, further comprising a decorrelator coupled between the adaptive EC means and the adaptive loudspeaker beamformer for decorrelation of the microphone signal.

7. The sound reinforcement system according to claim 1, further comprising a limiter coupled between the adaptive EC means and the adaptive loudspeaker beamformer for limiting gain in the sound reinforcement system.

8. The sound reinforcement system according to claim 6, further comprising an equalizer coupled between the decorrelator and the adaptive loudspeaker beamformer.

9. The sound reinforcement system of claim 1, wherein the sound reinforcement system, which may be a hands-free system is embodied as a public address system, a congress system, a conferencing system, or a communication system such as a passenger communication system for a vehicle such as a car, airplane or the like.

10. A sound system comprising:

at least one microphone;

at least one loudspeaker; and a loudspeaker beamformer configured to shape a directional pattern of sound from said at least one loudspeaker, wherein said directional pattern includes a null in a direction of a speaker.

11. The sound system of claim 10, further comprising a microphone beamformer configured to focus a reception beam of said at least one microphone on said speaker.

12. The sound system of claim 11, wherein said reception beam is complementary to said directional pattern.

13. The sound system of claim 11, further comprising a Dynamic Echo Suppressor (DES) coupled between the microphone beamformer and the loudspeaker beamformer for suppressing echoes.

14. The sound system of claim 13, wherein said DES includes dynamic echo noise suppressor.

15. The sound system of claim 10, further comprising an echo compensator coupled to the at least one microphone for generating an echo compensated microphone signal.

16. The sound system of claim 15, further comprising a decorrelator coupled between the echo compensator and the loudspeaker beamformer for decorrelation of the echo compensated microphone signal.

17. The sound system of claim 10, wherein said loudspeaker beamformer includes at least one of a Weighted Sum Beamformer, a Delay and Sum Beamformer and a Filtered Sum Beamformer.

18. A method of compensation in a sound system having at least one microphone and at least one loudspeaker, the method comprising the act of:

shaping a directional pattern of sound from said at least one loudspeaker, wherein said directional pattern includes a null in a direction of a speaker.

19. The method of claim 18, further comprising the act of:

focusing a reception beam of said at least one microphone on said speaker.

20. The method of claim 19, wherein said reception beam is complementary to said directional pattern.

* * * * *